US006062964A

United States Patent [19]

Chen et al.

[11] Patent Number: 6,062,964

[45] Date of Patent: May 16, 2000

[54] CHEMICAL MECHANICAL POLISHING APPARATUS FOR CONTROLLING SLURRY DISTRIBUTION

[75] Inventors: Hsueh-Chung Chen, Yung-Ho; Ming-Sheng Yang; Juan-Yuan Wu, both of Hsin-Chu, all of Taiwan

[73] Assignee: United Microelectronics Corp., Hsin-Chu, Taiwan

[21] Appl. No.: 09/393,909

[22] Filed: Sep. 10, 1999

[51] Int. Cl.[7] ..... B24B 57/00

[52] U.S. Cl. ..... 451/446; 451/60; 451/41

[58] Field of Search ..... 451/60, 41, 446, 451/287, 288, 921, 56, 530, 527

[56] References Cited

U.S. PATENT DOCUMENTS

| | | | |
|---|---|---|---|
| 4,490,948 | 1/1985 | Hanstein et al. | 451/60 |
| 5,554,064 | 9/1996 | Breivogel et al. | 451/60 |
| 5,658,185 | 8/1997 | Morgan, III et al. | 451/60 |
| 5,816,900 | 10/1998 | Nagahara et al. | 451/60 |
| 5,876,271 | 3/1999 | Oliver | 451/60 |

*Primary Examiner*—Derris Holt Banks

[57] ABSTRACT

A chemical mechanical polishing apparatus for controlling slurry distribution is disclosed. The slurry flowing through the mesh before transferring to the polishing pad, the mesh being used to distribute the slurry onto surface of the polishing pad. There are different netting densities over the mesh, achieving the purpose of controlling slurry distribution.

11 Claims, 2 Drawing Sheets

CHEMICAL MECHANICAL POLISHING APPARATUS FOR CONTROLLING SLURRY DISTRIBUTION

BACKGROUND OF THE INVENTION

1. Field of the Invention

The present invention relates to a chemical mechanical polishing (CMP) apparatus, and particularly to a chemical mechanical polishing apparatus for controlling slurry distribution.

2. Description of the Prior Art

After semiconductor processes move into deep sub-micro region, chemical mechanical polishing has become a standard fabricated technology, which is also an indispensably primary fabricated step in dual-damascene processes. FIG. 1 shows the diagram of a conventional equipment of planet-motion mechanism. The slurry brought by an underlying pump flows through a mesh 12 having distributed function, and into the backside of polishing pad 14, then flows out of the voids of polishing pad 14, in which the slurry distribution is important to the uniform of the metal chemical mechanical polishing. Due to the fact that the mesh 12 uses uniformity shaped net as shown in FIG. 2, it is unable to arbitrarily control slurry distribution. Therefore disclosure of a mesh capable of controlling slurry distribution to increase the polishing uniformity is necessary.

SUMMARY OF THE INVENTION

In accordance with the present invention, a chemical mechanical polishing apparatus for controlling slurry distribution is disclosed. The present invention comprises a planet-motion polishing pad, a wafer carrier, a polishing pump, and a mesh. The function of wafer carrier is to fix wafer on the polishing pad, avoiding wafer sliding during polishing. The slurry flowing through the mesh before transferring to the polishing pad, the mesh being used to distribute the slurry onto surface of the polishing pad. There are different netting densities over the mesh. The netting with higher density has smaller netting hole size through which smaller amount of the slurry passes, and the netting with lower density has larger netting hole size through which greater amount of the slurry passes.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Traditional chemical mechanical polishing apparatus uses a mesh with uniform hole size, which is unable to control the flow direction of slurry. Therefore, the present invention provides another type of mesh to control the flow direction of slurry, increasing polishing uniformity.

Figure 1:
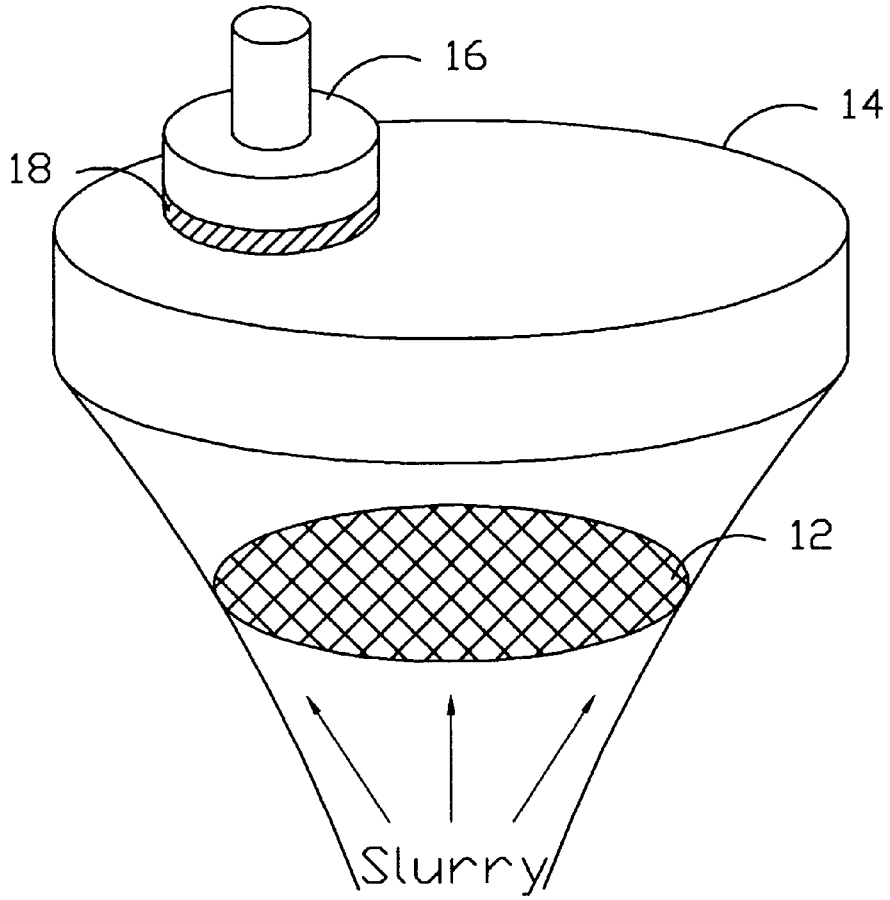
FIG.1(Prior Art)
FIG. 1 shows the diagram for chemical mechanical polishing apparatus of planet-motion mechanism.
Figure 2:
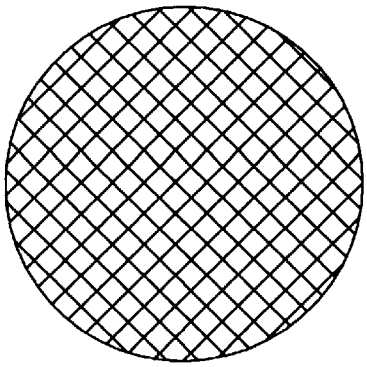
FIG.2(Prior Art)
FIG. 2 shows the standard mesh.
Figure 3:
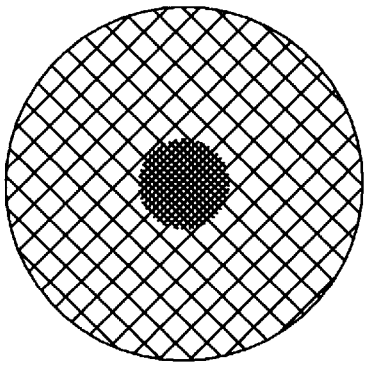
FIG. 3 shows the mesh of first embodiment in the present invention.
Figure 4:
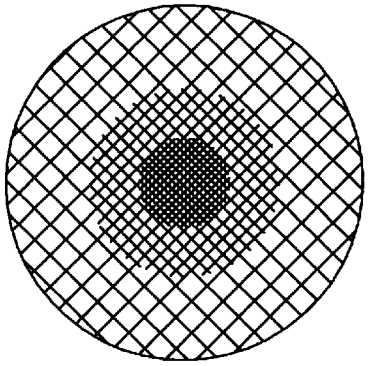
FIG. 4 shows the mesh of second embodiment in the present invention.
Figure 5:
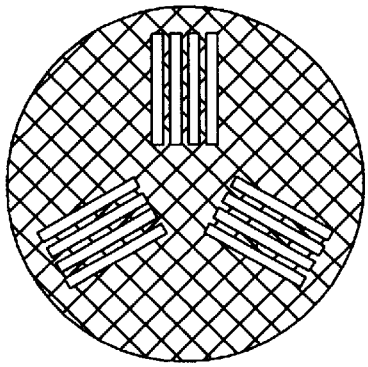
FIG. 5 shows the mesh of third embodiment in the present invention.

The following specification is illustrated by FIG. 1, which shows the diagram for chemical mechanical polishing apparatus of planet-type mechanism. The slurry brought by an underlying pump flows through a mesh 12 having distributed function, and into the backside of polishing pad 14, then flows out of the voids of polishing pad 14. The wafer carrier 16 is used to fixe the wafer 18 to the polishing pad 14, avoiding wafer 18 sliding to reduce polishing rate during polishing. Because of the polishing pad 14 is rotating in polishing, so the rotating polishing pad 14 have the function of distributing slurry. Moreover the characteristics of the present invention is the design of mesh 12. There are different netting densities over the mesh 12, in which netting with higher density has smaller netting hole size through which smaller amount of the slurry passes. The slurry distributing quantity to the polishing pad 14 will be smaller. The netting with lower density has larger netting hole size through which greater amount of the slurry passes. The slurry distributing quantity to the polishing pad 14 will be greater. FIG. 3 shows the mesh 12 of first embodiment in the present invention. The mesh 12 has circular periphery, and outer region of the mesh 12 has low density, inner region of the mesh 12 has high density. FIG. 4 shows the mesh 12 of second embodiment in the present invention. The mesh 12 has circular periphery, and there are three different netting densities on the mesh 12, wherein outer region of the mesh 12 has low density, middle region of the mesh 12 has middle density, and inner region of the mesh 12 has high density. FIG. 5 shows the mesh 12 of third embodiment in the present invention. The mesh 12 has circular periphery, and has rectangular netting for conducting flow of the slurry, and square netting.

Although specific embodiments have been illustrated and described, it will be obvious to those skilled in the art that various modifications may be made without departing from the spirit which is intended to be limited solely by the appended claims.

What is claimed is:

1. A chemical mechanical polishing (CMP) apparatus, said apparatus comprising:

a rotating polishing pad, a wafer under polish being placed on said polishing pad;

a slurry pump for transferring slurry onto a surface of said polishing pad; and a mesh, the slurry flowing through said mesh before transferring to said polishing pad, said mesh being used to distribute the slurry onto the surface of the polishing pad, wherein there are different netting densities over the mesh, in which the netting with a higher density has smaller netting hole size through which smaller amount of the slurry passes, and netting with a lower density has larger netting hole size through which greater amount of the slurry passes.

2. The apparatus according to claim 1, wherein said mesh has circular periphery, and has rectangular netting for conducting flow of the slurry, and square netting.

3. The apparatus according to claim 1, wherein said mesh has circular periphery, and outer region of the mesh has low density, inner region of the mesh has high density.

4. The apparatus according to claim 1, wherein said mesh has circular periphery, and there are three different netting densities on said mesh, wherein outer region of the mesh has low density, middle region of the mesh has middle density, and inner region of the mesh has high density.

5. The apparatus according to claim 1, wherein said mesh and said polishing pad have a gap of distance there between.

6. The apparatus according to claim 1, wherein said apparatus comprises a wafer carrier, and the function is to fix said wafer on said polishing pad, avoiding said wafer sliding during polishing.

7. A chemical mechanical polishing (CMP) apparatus, said apparatus comprising:

a rotating polishing pad, a wafer under polish being placed on said polishing pad;

a wafer carrier, and the function is to fix said wafer on said polishing pad, avoiding said wafer sliding during polishing, a slurry pump for transferring slurry onto surface a of said polishing pad; and a mesh, the slurry flowing through said mesh before transferring to said polishing pad, said mesh being used to distribute the slurry onto the surface of the polishing pad, wherein there are different netting densities over the mesh, in which netting with a higher density has smaller netting hole size through which smaller amount of the slurry passes, and netting with a lower density has larger netting hole size through which greater amount of the slurry passes.

8. The apparatus according to claim 7, wherein said mesh has circular periphery, and has rectangular netting for conducting flow of the slurry, and square netting.

9. The apparatus according to claim 7, wherein said mesh has circular periphery, and outer region of the mesh has low density, inner region of the mesh has high density.

10. The apparatus according to claim 7, wherein said mesh has circular periphery, and there are three different netting densities on said mesh, wherein outer region of the mesh has low density, middle region of the mesh has middle density, and inner region of the mesh has high density.

11. The apparatus according to claim 7, wherein said mesh and said polishing pad have a gap of distance there between.

* * * * *